United States Patent [19]

Feldman

[11] 4,297,110

[45] Oct. 27, 1981

[54] ZIRCONIUM ADDITIVES FOR RESIDUAL FUEL OIL

[75] Inventor: Nicholas Feldman, Woodbridge, N.J.

[73] Assignee: Exxon Research & Engineering Co., Florham Park, N.J.

[21] Appl. No.: 135,994

[22] Filed: Mar. 31, 1980

[51] Int. Cl.[3] ..... C01L 1/18

[52] U.S. Cl. ..... 44/66; 44/67; 44/68

[58] Field of Search ..... 44/67, 68, 66

[56] References Cited

U.S. PATENT DOCUMENTS

| | | | |
|---|---|---|---|
| 2,086,775 | 7/1937 | Lyons et al. | 44/9 |
| 2,197,498 | 4/1940 | Gulhmann | 44/66 |
| 2,844,112 | 7/1958 | Muller | 44/68 |
| 3,147,091 | 9/1964 | Toulmin | 44/51 |
| 3,205,053 | 9/1965 | McCord | 44/66 |
| 3,231,592 | 1/1966 | McCord | 260/414 |
| 3,594,138 | 7/1971 | Badin | 44/70 |
| 3,634,051 | 1/1972 | Phillips | 44/67 |

FOREIGN PATENT DOCUMENTS

| | | |
|---|---|---|
| 803319 | 10/1958 | United Kingdom . |
| 1377927 | 9/1974 | United Kingdom . |

*Primary Examiner*—Jacqueline V. Howard
*Attorney, Agent, or Firm*—Robert J. North

[57] ABSTRACT

Zirconium salts of carboxylic acids as additives in residual fuel oil to reduce particulate emission. The additives are especially effective in decreasing particulate emission in the combustion of No. 6 fuel oil, to aid in meeting current particulate emission standards.

15 Claims, No Drawings

ZIRCONIUM ADDITIVES FOR RESIDUAL FUEL OIL

BACKGROUND OF THE INVENTION

1. Field of the Invention

This invention relates to the use of specific zirconium salts in residual fuel oil to reduce the amount of particulate matter formed during combustion.

2. Brief Description of the Prior Art

Residual fuel oils, including Grades Nos. 4, 5 and 6 (ASTM D-396), are widely used in a variety of industrial heating and steam boiler applications. A particularly desired fuel oil is No. 6, which is extensively used by utility and power companies.

State and federal EPA emission standards are currently limiting the use of residual fuels which produce excessive amounts of particulate emission during combustion and thus are not in compliance with standards.

However, the situation is relatively complicated, since state-to-state emission standards tend to be different and compliance by a residual fuel oil in one state may not necessarily be achieved in another, and further, since standards are continuously subject to change, a fuel oil currently in compliance may not be in compliance in the near future in the same location and under the same end-use conditions.

Fuels which tend to produce excessive amounts of particulate emission generally have one or more characteristics associated with them: a sulfur content above about 1 percent; a Conradson Carbon Residue (ASTM D-189, also termed "Con Carbon" in the art) above about 7 percent; or a high asphaltene content. Fuels yielding particulate emissions that surpass the existing standards can't be directly used, but in some cases can be blended in admixture with fuels that do meet existing standards, which are generally low in sulfur and/or low in "Con Carbon" and asphaltene content. This situation has resulted in an overall increased demand for fuel oils which meet emission standards despite their diminishing supply and attendant increase in cost.

What is desired is a process for increasing the utility of these high emission yielding residual fuel oils for industrial heating purposes in a manner that results in acceptable particulate emissions, despite a high sulfur content and/or a high Con Carbon residue.

In the area of related problems, it is known in the art that the use of specific additives in certain hydrocarbon fuels, can reduce smoke or soot upon combustion, in certain instances.

U.S. Pat. No. 3,594,138 describes the use of metal salts of alkanoic acids, particularly Group IIA metal salts, for reducing soot and smoke produced upon combustion of hydrocarbon fuels used in compression and spark ignition engines. Preferred are barium and calcium salts of alkanoic acids and particularly preferred is the combination of said salt with an ether, such as ethylene glycol monomethyl ether. Zirconium salts are also mentioned.

U.S. Pat. No. 2,086,775 discloses a process for increasing the efficiency of internal combustion engines by the addition of organometallic compounds, including beta-diketone derivatives of cobalt, nickel, manganese, iron, copper, uranium, molybdenum, vanadium, zirconium, beryllium, platinum, palladium, chromium, aluminum, thorium, and the rare earth metals. Metals having special value are described as being beta-diketonates of cobalt, nickel, iron, copper and manganese.

U.S. Pat. No. 2,197,498 discloses the stabilization of hydrocarbon motor fuels containing dissolved organometallic compounds by the addition of an oil or water-soluble organic acid to prevent precipitation thereof. Included among sixteen metals mentioned, including rare earth metals, are zirconium organometallic compounds.

However, none of the above-described references disclose the effectiveness of specific additives in reducing particulate emission during combustion of specifically residual fuel oil, and particularly No. 6 fuel oil.

U.S. Pat. Nos. 3,205,053 and 3,231,592 describe metal oxide-fatty acid complexes which are useful as additives in residual fuel oils containing vanadium and sulfur in which the complex functions to reduce boiler corrosion by converting molten vanadium compounds to a high melting vanadate ash that can be exhausted. However, use of the described metal oxide-fatty acid complex, in which zirconium oxide is mentioned along with fifteen other metal oxides, including rare earth metal oxides, operates to increase the level of particulate emission. Further, the described complex generally requires two different metals and is generally insoluble in the residual oil and must be dispersed therein by means of dispersing agents.

We have unexpectedly found that by adding a zirconium salt of a fatty acid, tall oil or naphthenic acid, to a residual fuel oil, and particularly No. 6 fuel oil, the amount of particulate matter formed during combustion can be reduced in an amount of about 10 to 50 percent or greater. Particularly surprising is that the described zirconium salt is effective when used specifically with No. 6 fuel oil, whereas the same acid salts with other metals, for example, barium and magnesium, which are described in the art as being effective in reducing smoke or soot in the combustion of certain hydrocarbon fuel oils, were found to be ineffective in this particular application.

In accordance with this invention, there is provided a process for reducing the amount of particulate matter formed during the combustion of a residual fuel oil comprising the steps of:

(a) dissolving in said fuel oil an effective trace amount of an additive consisting essentially of a zirconium salt of a carboxylic acid selected from the group consisting of $C_4$–$C_{22}$ linear or branched fatty acids, tall oil, naphthenic acid, or mixtures thereof, said amount being effective in reducing the amount of particulate matter formed during combustion as compared to said process conducted in the absence of said zirconium salt; and (b) combusting said resulting fuel oil.

Further provided is a composition comprising a residual fuel oil having dissolved therein an effective trace amount of an additive consisting essentially of a zirconium salt of a carboxylic acid, selected from the group consisting of $C_4$–$C_{22}$ linear or branched fatty acids, tall oil, naphthenic acid or mixtures thereof, said amount being effective in reducing the amount of particulate matter formed during combustion of said fuel oil.

Preferred embodiments of the above-described process and composition are where the residual fuel oil is No. 6 fuel oil, the zirconium additive is zirconium octanoate, present in said fuel oil in about 10–1000 ppm by weight, taken as the metal.

DESCRIPTION OF THE INVENTION AND PREFERRED EMBODIMENTS

The novelty of the present invention resides in the discovery that zirconium salts of certain carboxylic acids exert a beneficial effect on residual fuel oil, particularly No. 6 fuel oil, in reducing the amount of particulate matter formed during combustion. The term "residual fuel oil" as used herein, is well-known and as described hereinabove, and includes Grades No. 4, No. 5, and No. 6 residual fuel oils, meeting the specifications of ASTM D-396. Particularly preferred is No. 6 fuel oil.

The reason these particular zirconium additives exhibit this surprising effect is not clearly understood. It may be that the subject compounds promote and activate the complete oxidation of hydrocarbon and sulfur-containing constituents in the fuel to volatile or gaseous compounds during combustion, in a highly specific manner.

The subject zirconium salts or compounds, also termed "additives" herein, operative in the instant invention, consist essentially of the zirconium salts of $C_4$–$C_{22}$ linear or branched fatty acids; tall oil; naphthenic acid, or mixtures thereof, which are soluble in residual fuel oil and particularly in No. 6 fuel oil. By the term "consist essentially of" is meant that small amounts of other materials may also be present that don't interfere with or inhibit the action of the zirconium additives in reducing particulate matter formed during combustion of residual fuel oils.

Representative examples of $C_4$–$C_{22}$ linear or branched fatty acids and mixtures thereof include butyric acid, isobutyric acid, pentanoic acid, hexanoic acid, heptanoic acid, octanoic acid, isooctanoic acid, 2-ethylhexanoic acid, 3-ethylhexanoic acid, decanoic acid, dodecanoic acid, octadecanoic acid, eicosanoic acid, heneicosanoic acid, docosanoic acid, and the like. A preferred range is $C_6$–$C_{18}$ linear or branched fatty acids and mixtures thereof and a particularly preferred fatty acid is octanoic acid, its isomers and mixtures thereof.

"Tall oil" is a well-known commodity and is a commercially available mixture of rosin acids, fatty acids and other materials obtained by the acid treatment of the alkaline liquors from the digesting of pine wood.

"Naphthenic acid" is a general term for saturated higher fatty acids derived from the gas-oil fraction of petroleum by extraction with caustic soda solution and subsequent acidification.

Preferred zirconium additives are those of the described fatty acids and particularly those of octanoic acid, its isomers, and mixtures thereof. By the term "isomers of octanoic acid," as used herein, is meant other saturated monocarboxylic acids containing eight carbon atoms and having an alkyl group which can be of various degrees of carbon branching. A preferred zirconium octanoate additive contains a mixture of straight chain and branched octanoic acid zirconium salts.

Methods of preparing the subject zirconium salts are well-known in the art and generally said salts are commercially available.

The zirconium additive is incorporated into the residual fuel oil by dissolving therein. This is accomplished by conventional methods as by heating, stirring and the like.

The amount of zirconium additive to be used is an "effective trace amount" that will reduce the amount of particulate matter formed during combustion of the residual fuel oil as compared to the combustion of said fuel oil in the absence of said additive. By the term "effective trace amount" is quantitatively meant an amount of about 1 to 1000 ppm by weight and preferably 10–1000 ppm by weight, zirconium additive, taken as metallic zirconium, in said fuel oil, and particularly preferred about 50 to 150 ppm by weight zirconium additive, taken as metallic zirconium, in said fuel oil. However, lower and higher amounts than the 1–1000 ppm range can also be present provided an effective trace amount, as defined herein, is present in the residual fuel oil.

By the term "reduce the amount of particulate matter formed during combustion," as used herein, is meant that at least about a five percent reduction in formed particulate matter, and preferably from about 10 to 50 percent and greater, reduction in formed particulate matter is achieved as compared to the combustion of the residual fuel oil in the absence of the subject zirconium additive.

In the process, the fuel oil containing said additive is generally mixed with oxygen, usually in the form of air, to form a fuel/air mixture prior to combustion. Generally, the amount of air utilized is an excess over the stoichiometric amount to completely combust the fuel oil to carbon dioxide and water. The reason for utilizing this excess is that complete mixing does not always occur between the fuel oil and the air, and that also a slight excess of air is desirable since it serves to reduce the tendency of soot and smoke formation during combustion. Generally, the excess of air used is about 2 to 35 percent (0.4 to 7 percent based on oxygen) over the stoichiometric amount depending upon the actual end-use conditions which may vary considerably from one type of industrial boiler to the next. One disadvantage in using a large excess of air is that a greater amount of heat is lost through entrainment that would otherwise be utilized for direct heating purposes. We have found that by use of the subject zirconium additives, less excess air is required to reduce smoke and soot formation and thus the heating efficiency of the residual fuel oil is greater, as well as resulting in a reduction of particulate emission.

The above-described step of mixing fuel oil and air is conventional and is usually accomplished for example, by steam or air atomization to produce a fine spray which is then combusted to maintain and support a flame. The combustion is controlled and conducted at a particular "firing rate" which is usually expressed as lbs/minute of fuel oil combusted.

The combustion of residual fuel oil is usually carried out in conventional industrial boilers, utility boilers, refinery furnaces and the like.

The amount of particulate matter formed during combustion of residual fuel oil will vary over a broad range and is dependent upon a number of factors such as type of boiler, boiler size, number and type of burners, source of the residual fuel oil used, amount of excess air or oxygen, firing rate and the like. Generally, the amount of particulate matter formed will be in the range of about 0.01 to 1.0 weight percent of the fuel oil used and higher. One weight percent corresponds to one gram particulate matter formed from the combustion of 100 grams of fuel oil. The amount of particulate matter formed, herein termed "total particulate matter," is actually the sum of two separate measurements; "tube deposits," the amount of particulate matter deposited inside of the boiler, and two, "filtered stack particulate," which is the amount of particulate matter formed which escapes the boiler and is actually emitted out of the stack into the air. EPA measurements are generally only concerned with filtered stack particulate which is directly released into the air environment and contributes to a decrease in air quality. However, "tube deposits" lead to corrosion of the equipment, frequent "clean-outs" and add to the total operating costs. Furthermore, as tube deposits collect on the inside of the apparatus, a critical crust thickness is reached and further tube deposits are then entrained in stack particulate, which significantly increases the amount of particulate emission. Thus, in order to fully assess the overall operating advantages of a particular residual fuel oil in a boiler operation, the amount of tube deposits should also be considered, as well as total stack particulate for compliance with emission standards.

The amount of allowed stack particulate will vary from state to state and is also subject to a minimum amount allowed under Federal EPA standards. For example, in Florida, the currently allowable limit for existing power plants is 0.10 lbs. particulate emission per million BTU, which is equivalent to about 1.85 weight percent of particulate stack emission per weight of combusted fuel oil. Since the allowable emission standards will vary from jurisdiction to jurisdiction, differing amounts of the subject zirconium additive will be necessary to produce a residual fuel oil composition in compliance with those standards.

Measurement of the amount of "stack particulate matter" is conducted by EPA Method #5 Stack Sampling System, "Determination of Particulate Emissions from Stationary Sources" and is described in the Federal Register.

The particulate stack emissions are generally comprised of particulate carbon, sulfur-containing hydrocarbons, inorganic sulfates and the like.

Also a subject of this invention is a composition comprising a residual fuel oil having dissolved therein an effective trace amount of an additive consisting essentially of a zirconium salt of a carboxylic acid, selected from the group consisting of $C_4$–$C_{22}$ linear or branched fatty acids, tall oil, naphthenic acid, or mixtures thereof, said amount being effective in reducing the amount of particulate matter formed during combustion of said fuel oil, as compared to said composition in the absence of said zirconium salt.

The nature and scope of the zirconium salts as additives are described hereinabove and need not be reiterated. A preferred zirconium salt is zirconium octanoate, its isomers, or mixtures thereof, and particularly preferred is a mixture of the straight chain and branched octanoic acid zirconium salts.

A preferred residual fuel oil is No. 6 fuel oil and the reduced amount of particulate matter formed during combustion compared to the fuel oil in the absence of the additive is at least about 5%, and preferably 10–50 percent, and greater.

The amount of zirconium salt present in the composition is about 1–1000 ppm by weight, preferably 10–1000 ppm by weight, taken as the metal and most preferably about 50–150 ppm by weight, taken as the metal. However, lower and higher amounts than the 1–1000 ppm range can also be present provided an effective trace amount, as defined herein, is present in the residual fuel oil.

Methods of making the zirconium salt and the composition are described hereinabove, as well as the process for utilizing said composition and need not be reiterated.

The following examples are illustrative of the best mode of carrying out the invention as contemplated by us and should not be construed as being limitations on the scope and spirit of the instant invention.

EXAMPLE 1

Combustion runs were carried out in a 50 horsepower Cleaver Brooks horizontal fire tube boiler having a nominal firing rate of 2 lbs/min. of residual fuel oil. By means of appropriate baffles and heat exchanger tubes, the formed combustion gases are forced to pass the length of the boiler four times before being emitted out of the stack assembly. A No. 6 fuel oil, containing 50 ppm by weight of an organometallic compound (listed below), taken as the metal, was atomized by means of a low pressure (10 psi) air-atomizing nozzle. The viscosity of the fuel oil at the nozzle was maintained at 30 centistokes by heating the fuel to a predetermined temperature (about 105° C.). Prior to contacting the burner gun, the atomized fuel oil was mixed with a measured amount of excess "secondary" air which was forced through a diffuser plate to insure efficient combustion. The secondary air was provided by a centrifugal blower mounted in the boiler head. The amount of secondary air was controlled by means of a damper which was regulated to keep the oxygen level in the atomized fuel at about 1.5% in excess (over that needed stoichiometrically to completely combust the fuel).

To insure operational stability, the boiler was allowed to warm up for a minimum of one hour before the start of a run. The fuel firing rate was adjusted to about 1.5 lbs./min. by periodically monitoring the loss in weight of the oil supply drum which was set on top of the beam scale.

Total particulate matter formed was determined by adding the amount of stack particulate measured isokinetically (EPA Method 5 Stack Sampling System) to the amount deposited in the tubes of the boiler, i.e., "tube deposits."

The EPA Method 5 Stack Sampling System was conducted with a commercially available system for this purpose. This unit consisted of an 18-inch glass lined probe, a cyclone, a 125 mm glass fiber filter and four impingers. The first two impingers contained water, the third was empty and the last one contained silica gel. With the exception of the impingers, the entire sampling train was maintained about 175° C. to insure that the stack gases entering the sampling system were above the $H_2SO_4$ dew point.

In order to measure boiler tube deposits, a removable thin wall stainless steel liner was inserted before each run into one of the tubes. The steel liners were removed from the boiler one day after each run and the deposits in them recovered.

The fuel oil used (designated Test Fuel #1) in the runs analyzed for the following constituents:

| Analysis of Test Fuel #1 | |
|---|---|
| Sulfur | 2.2 wt. % |
| Con Carbon[a] | 12.5 wt. % |
| Ash[b] | 0.08 wt. % |
| Vanadium | 290 ppm |
| Nickel | 43 ppm |
| Iron | 7 ppm |

-continued

| Analysis of Test Fuel #1 | |
|---|---|
| Sodium | 35 ppm |

[a]ASTM-D-189
[b]ASTM-D-482

The results of the runs are listed below in Table I. The total particulate matter formed during combustion, and termed herein "total particulate," comprised of the sum of tube deposits and stack particulate, individually listed are expressed as a weight percentage of the fuel oil used. The "% change" is the relative increase or decrease in total particulate formed as compared to the control run, i.e., the No. 6 fuel oil combusted in the absence of any additive. The listed additives used were obtained commercially. The zirconium octanoate used was a commercially available formulation from Tenneco Chemicals, under the label "Zirconium Octoate." The sample possessed the following specifications: metal content, 6.0±0.1%, solids (max.) 28%; specific gravity (77° F.), 0.840–0.880; flash point (Pensky-Marten Closed Cup), 104° F.

TABLE I

Effect of Additives on Lowering Total Particulate

| Additive (50 PPM Metal) | Tube Deposits | Stack Particulate | Total Particulates Wt. % on Fuel | Total Particulates % Change |
|---|---|---|---|---|
| None (control) | 0.263 | 0.103 | 0.366 | — |
| Mg[e] | 0.278 | 0.130 | 0.408 | +11 |
| Ba[d] | 0.314 | 0.111 | 0.425 | +16 |
| Mn[e] | 0.274 | 0.089 | 0.363 | −1 |
| Fe[e] | 0.257 | 0.083 | 0.340 | −7 |
| Zr[d] | 0.189 | 0.074 | 0.263 | −28 |

[d]Octanoate
[e]Naphthenate

As is seen in Table I, the use of zirconium octanoate significantly lowered the amount of particulate produced as compared to the control and the use of other closely related metal additives. Also, the value of stack particulate emission is seen to be significantly lower for the zirconium run as compared to the control and other metal additives.

EXAMPLE 2

Following the same general procedure and using the Cleaver Brooks boiler described in Example 1, the following runs were made utilizing different concentrations of zirconium octanoate (described above in Example 1) at 50 ppm, 100 ppm and 150 ppm, by weight taken as the metal, in No. 6 fuel oil, and different concentrations from 1.0 to 2.0% of excess secondary oxygen. The No. 6 fuel oil used (designated Test Fuel No. 2), analyzed for the following constituents:

| Analysis of Test Fuel #2 | |
|---|---|
| Sulfur | 2.4 wt. % |
| Con Carbon | 14.5 wt. % |
| Ash | 0.10 wt. % |
| Vanadium | 390 ppm |
| Nickel | 55 ppm |
| Iron | 8 ppm |
| Sodium | 34 ppm |

Results of the runs are listed below in Tables II, III, and IV at different levels of excess oxygen and loadings of zirconium octanoate, given as "PPM Zr."

As noted, individual values are listed for the measured stack particulate, tube deposits, and total particulate. The "% improvement" is also listed describing the decrease in total particulate as compared to the base fuel (control run without any additive) for each series.

For example, in Table II, the use of 100 ppm zirconium octanoate, at the 1.0% excess oxygen level, resulted in about a 40% decrease in total particulate as compared to the base fuel without any additive.

TABLE II

Total Particulate at 1.0% Excess Oxygen

| | Wt. % on Fuel | | |
|---|---|---|---|
| | Base Fuel | 100 PPM Zr | 150 PPM Zr |
| Stack Paticulate | 0.418 | 0.253 | 0.235 |
| Tube Deposits | 0.181 | 0.107 | 0.090 |
| Total | 0.588 | 0.360 | 0.325 |
| % Improvement | — | 40 | 46 |

TABLE III

Total Particulate at 1.5% Excess Oxygen

| | Wt. % on Fuel | | | |
|---|---|---|---|---|
| | Base Fuel | 50 PPM Zr | 100 PPM Zr | 150 PPM Zr |
| Stack Particulate | 0.302 | 0.245 | 0.203 | 0.202 |
| Tube Deposits | 0.127 | 0.085 | 0.070 | 0.067 |
| Total | 0.429 | 0.330 | 0.273 | 0.269 |
| % Improvement | — | 23 | 36 | 37 |

TABLE IV

Total Particulate at 2.0% Excess Oxygen

| | Wt. % on Fuel | |
|---|---|---|
| | Base Fuel | 100 PPM Zr |
| Stack Particulate | 0.216 | 0.186 |
| Tube Deposits | 0.078 | 0.044 |
| Total | 0.294 | 0.230 |
| % Improvement | — | 22 |

EXAMPLE 3

Following the same general procedure described in Example 2, except that a firing rate of 0.75 lbs/min. in the same Cleaver Brooks boiler was used, the following runs were made.

The results listed in Table V show that the base fuel (Test Fuel #2) gives less particulate emission at a lower firing rate (0.75 lbs./min. vs. 1.5 lbs/min. as in Example 2). And, addition of 100 ppm Zr octanoate to the base fuel oil, run at the 2.0% excess oxygen level, yields a 22% reduction in stack particulate and a 24% reduction in total particulate.

TABLE V

Total Particulate at 2.0% Excess Oxygen

| | Wt. % on Fuel | |
|---|---|---|
| | Base Fuel | 100 ppm Zr |
| Stack Particulate | 0.160 | 0.125 |
| Tube Deposits | 0.045 | 0.030 |
| Total | 0.205 | 0.155 |
| % Improvement | — | 24% |

What is claimed is:

1. A process for the combustion of a residual fuel oil comprising the steps of:

(a) dissolving in said fuel oil an effective trace amount of an additive consisting essentially of a zirconium salt of a carboxylic acid selected from the group consisting of $C_4$–$C_{22}$ linear or branched fatty acids, tall oil, naphthenic acid, or mixture thereof, said amount being effective in reducing the amount of particulate matter formed during combustion; and (b) combusting said resulting fuel oil.

2. The process of claim 1 wherein said residual fuel oil is No. 6 fuel oil.

3. The process of claim 1 wherein said amount of particulate matter formed is reduced by about 10–50 percent.

4. The process of claim 1 wherein said fuel oil contains above about 1 weight percent sulfur.

5. The process of claim 1 wherein said additive is the zirconium salt of octanoic acid, its isomers, or mixtures thereof.

6. The process of claim 1 wherein said zirconium salt is present in said resulting fuel oil in about 1–1000 ppm by weight, taken as metallic zirzonium.

7. The process of claim 6 wherein said zirconium salt is present in said resulting fuel oil in about 50–150 ppm by weight, taken as metallic zirconium.

8. A process for reducing the amount of particulate matter formed during the combustion of No. 6 fuel oil comprising the steps of:

(a) dissolving zirconium octanoate, its isomers, or mixtures thereof, in said fuel oil resulting in a fuel oil containing about 50–150 ppm by weight of said zirconium octanoate, taken as metallic zirconium; and (b) combusting said resulting fuel oil.

9. A composition comprising a residual fuel oil having dissolved therein an effective trace amount of an additive consisting essentially of a zirconium salt of a carboxylic acid, selected from the group consisting of $C_4$–$C_{22}$ linear or branched fatty acids, tall oil, naphthenic acid, or mixtures thereof, said amount being effective in reducing the amount of particulate matter formed during combustion of said fuel oil.

10. The composition of claim 9 wherein said residual fuel oil is No. 6 fuel oil.

11. The composition of claim 9 wherein said residual fuel oil contains above about 1 weight percent sulfur.

12. The composition of claim 9 wherein said zirconium salt is present in the composition in about 1–1000 ppm by weight, taken as metallic zirconium.

13. The composition of claim 12 wherein said zirconium salt is present in the composition in about 50–150 ppm by weight, taken as metallic zirconium.

14. The composition of claim 19 wherein said zirconium salt is zirconium octanoate, its isomers, or mixtures thereof.

15. a composition comprising No. 6 residual fuel oil having dissolved therein zirconium octanoate, its isomers, or mixtures thereof, in an amount of about 50–150 ppm by weight, taken as metallic zirconium.

* * * * *